United States Patent [19]

Nozaki

[11] Patent Number: 4,551,578

[45] Date of Patent: Nov. 5, 1985

[54] BALL AND SOCKET TYPE SUSPENSION INSULATOR

[75] Inventor: Hiroshi Nozaki, Nagoya, Japan

[73] Assignee: NKG Insulators, Ltd., Japan

[21] Appl. No.: 712,605

[22] Filed: Mar. 18, 1985

[30] Foreign Application Priority Data

Mar. 28, 1984 [JP] Japan ..... 59-60028

[51] Int. Cl.[4] ..... H01B 17/08; H01B 17/38

[52] U.S. Cl. ..... 174/182; 174/196

[58] Field of Search ..... 174/182, 189, 196

[56] References Cited

U.S. PATENT DOCUMENTS 2,008,414 7/1935 Fischer ..... 174/182

OTHER PUBLICATIONS

*Ohio Brass Insulator and Electrical Equipment Catalog No. 28,* Copyright 1953 by Ohio Brass Company, Mansfield, Ohio, pp. 50, 51, 142 and 143.

*Primary Examiner*—Laramie E. Askin

*Attorney, Agent, or Firm*—Parkhurst & Oliff

[57] ABSTRACT

A ball and socket type suspension insulator, wherein the radius of curvature at the fillet portion between the shank portion and a ball portion of a ball pin buried and secured into the inside of a head portion of an insulator body is designed at 30–40% of the diameter of the pin shank portion, and the angle which a contact surface between the socket portion of the cap attached to the outer surface of the head of the insulator body and the ball pin forms with respect to the horizontal plane is 38°–45°.

1 Claim, 4 Drawing Figures

BALL AND SOCKET TYPE SUSPENSION INSULATOR

BACKGROUND OF THE INVENTION (1) Field of the Invention

The present invention relates to a ball and socket type suspension insulator especially excellent in fatigue strength.

(2) Description of the Prior Art

Taking into account the interchangeability among the products of the manufacturers, the profile of the coupling portion between the ball pin and the socket of the ball and socket type suspension insulator is specified by International Electrotechnical Commission (IEC), etc. For instance, in the case of the suspension insulator of U210B (210 KN), the diameter (D) of the shank portion of the pin, the radius of curvature, (r), at the fillet portion between the pin shank portion and the ball portion, and the radius of curvature, (R), at the contact portion between the ball pin and the socket as shown in FIG. 2 are defined at 21 mm, 3.5 mm and 27 mm, respectively. When the fatigue limit of load amplitude is measured upon repeated application of various load amplitudes onto the suspension insulator having such a profile of the coupling portion while the average tensile load of 56 KN corresponding to 26.7% of the guaranteed electromechanical failing load (210 KN) is being applied thereonto, S–N curves as shown in FIG. 4 are obtained. The load amplitude at 2,000,000 repetitions corresponding to the fatigue limit of carbon steel which is ordinarily used in the ball pin of the suspension insulator is ±6.7% of the guaranteed electromechanical failing load, which is to be the fatigue limit of load amplitude of the conventional suspension insulator.

However, in the power transmission lines passing through the area where heavy snow and/or heavy ice attaches to the insulator or the wind pressure largely varies, the insulator has the drawback that since the load variation exceeding the above fatigue limit of load amplitude frequently occurs due to sleet jump when the attached snow and/or ice drops and galloping by wind, it can not maintain its mechanically supporting function over a long period of time, and therefore, a higher strength suspension insulator having one rank larger coupling size had to be used. In order to solve this drawback, various contrivances have been repeatedly done, for instance, changing of the material of the ball pin into a low alloy steel excellent in the mechanical strength, but the increase in the fatigue strength of the material affords substantially no improving effect on the fatigue strength of the ball pin. Further, trial has been done to mitigate the stress concentration through enlarging the radius of curvature, (r), at the fillet portion between the pin shank portion and the ball portion. However, a desired effect cannot be obtained unless the radius of curvature is set at a considerably large value, which increases the coupling size and unit length of the insulator. Thus, such countermeasure has been difficult to be practically applied.

SUMMARY OF THE INVENTION

It is therefore an object of the present invention to eliminate the drawbacks of the prior art.

More specifically, the object of the present invention is to provide a ball and socket type suspension insulator in which the fatigue limit of load amplitude is increased while the coupling size is kept constant.

According to the present invention, there is a provision of a ball and socket type suspension insulator in which the radius of curvature of the fillet portion between a shank portion and a ball portion of a ball pin which is buried and secured into the inside of a head of an insulator body is set at 30–40% of the diameter of the pin shank portion; and an angle which the contact surface between the socket portion of the cap attached to the outer surface of the head of the insulator body and the ball pin forms with respect to the horizontal plane is 38°–45°.

These and other objects, features and advantages of the invention will be well appreciated upon reading of the following description of the invention with understanding that some modifications, variations and changes of the invention could be easily done by the skilled in the art to which the invention pertains without departing from the spirit of the invention or the scope of the claim appended hereto.

BRIEF DESCRIPTION OF THE DRAWINGS

For the better understanding of the invention, reference is made of the attached drawings, wherein.

DETAILED DESCRIPTION OF THE INVENTION

Figure 1:
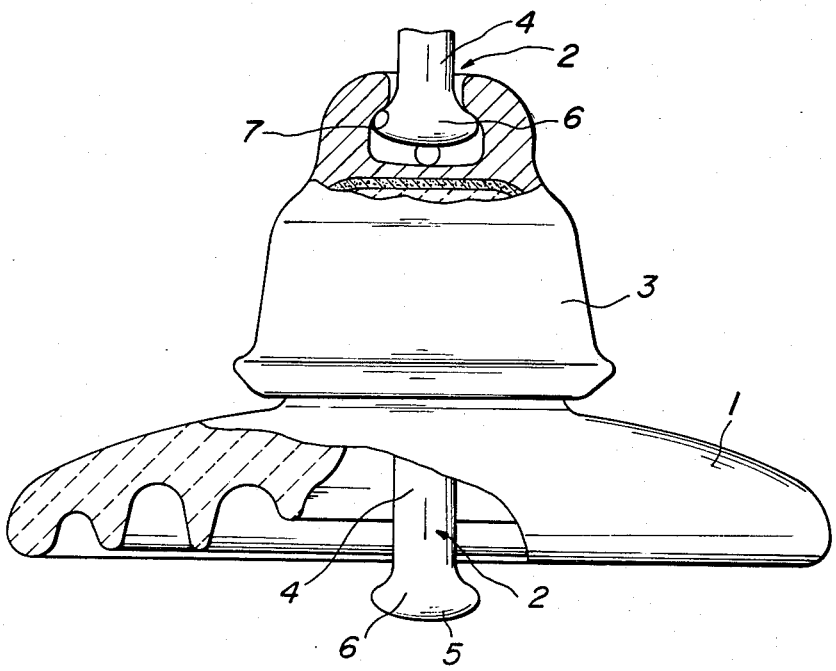
FIG. 1 is a partially broken front view of an embodiment of the ball and socket type suspension insulator according to the present invention.
Figure 2:
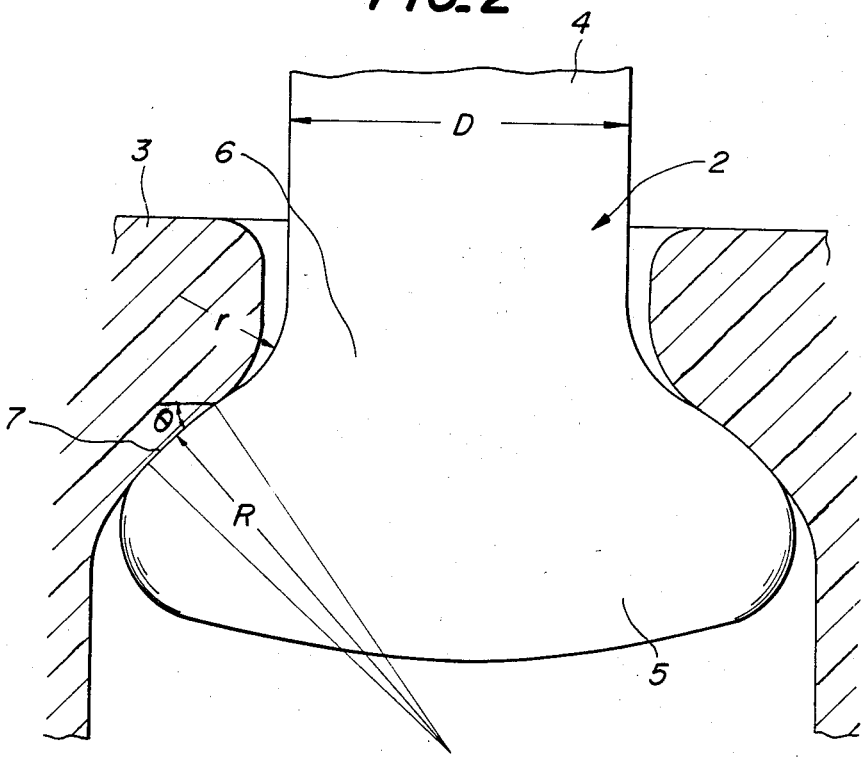
FIG. 2 is an enlarged view of a principal portion of FIG. 1.

The invention will be described more in detail with reference to the drawings, in which reference numerals (1), (2) and (3) represent an insulator body of a ball and socket type suspension insulator, a ball pin made of carbon steel and buried and secured into the inside of a head thereof, and a socket attached to the outer surface of the head of the insulator body 1, respectively. As shown in FIG. 2 in an enlarged scale, the radius of curvature, (r), and the fillet portion (6) between a pin shank portion (4) and a ball portion (5) of the ball pin (2) is designed at 30–40% of the diameter (D) of the pin shank portion. While the radius of curvature, (r), at the fillet portion (6) as defined by the above International Electrotechnical Commission with respect to the suspension insulator of 210 KN is 16.7% of the diameter (D) of the pin shank portion, the radius of curvature at the joining portion in the present invention is designed twice that in the conventional suspension insulator, and this ratio in the illustrated embodiment is 34%. While the angle ($\theta$) which the contact surface (7) between the socket (3) and the ball pin (2) forms with respect to the horizontal plane is set at about 35°–37° in accordance with the International Electrotechnical Commission, the contact surface in the present invention is designed as a considerably steep inclined surface of 38°–45°, and the ball portion (5) of the ball pin (2) is provided with an inclined surface having the same profile.

In the thus constituted suspension insulator, since the contact surface between the socket (3) and the ball pin (2) is designed as a considerably steeper inclined surface than in the conventional insulator, the radius of curvature, (r), of the fillet portion (6) can be made larger without enlarging the coupling size, and the value of the bending stress produced at the fillet portion (6) of the ball pin (2) can be reduced by about 20% than in the case of the conventional suspension insulator, because the vertical load component with respect to the socket contact surface lessens when the tensile load is applied.

Figure 3:
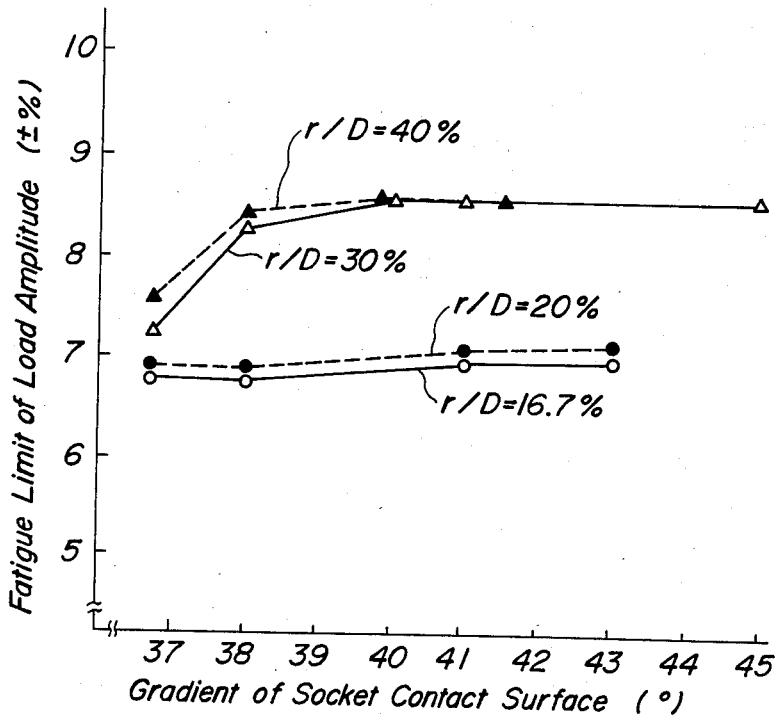
FIG. 3 is a graph showing the fatigue limit of load amplitude when the gradient of socket contact angle is varied.

FIG. 3 is a graph showing results of the fatigue limit of load amplitude measured according to the above-mentioned method with respect to the ball socket type suspension insulator in which the ratio r/D between the radius of the curvature, (r), at the fillet portion (6) of the ball pin (2), and the diameter (D) of the pin shank portion and the gradient formed by the contact surface (7) relative to the horizontal plane are varied in various values. This figure shows that when the radius of curvature, (r), is set at 30–40% of the diameter (D) of the pin shank portion and the contact surface (7) forms an angle of 38°–45° with respect to the horizontal plane, the fatigue limit of load amplitude is increased by 23–28% from the conventional value of 6.7% to 8.3–8.6% relative to the guaranteed electromechanical failing load.

Figure 4:
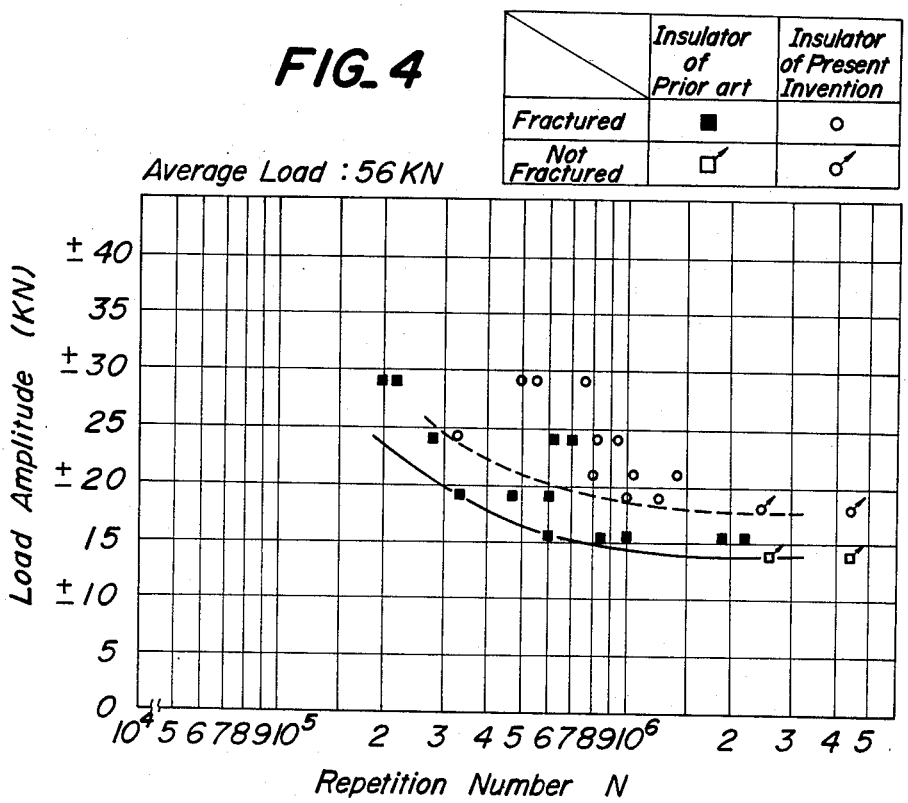
FIG. 4 is a graph showing the fatigue characteristics in the insulators of the present invention and the prior art.

FIG. 4 is a fatigue characteristics diagram showing results of fatigue limits measured upon repeated application of various load amplitudes with respect to the ball socket type suspension insulator of the prior art specified by the International Electrotechnical Commission and that of the present invention. This figure shows that the fatigue limit of load amplitude corresponding to the 2,000,000 repetitions is increased by about 28% from 14 KN (6.7%) to 18 KN (8.6%). As shown in the above, the fatigue limit of load amplitude is conspicuously improved when the radius of curvature, (r), of the fillet portion (6) of the ball pin (2) and the gradient of the contact surface (7) between the socket (3) and the ball pin (2) are within the respective ranges of the present invention, but when these values become larger over these respective ranges, a desired tensile strength cannot be maintained unless the thickness of the ball at the fillet portion is increased. Thus, the above-defined ranges are most preferred.

As mentioned in the foregoing, according to the present invention, the radius of curvature at the fillet portion between the shank portion and the ball portion of the ball pin at which the stress is likely to concentrate is designed larger and the angle which the contact surface between the socket and the ball pin forms relative to the horizontal plane is also designed larger as compared with the conventional suspension insulator, so that while the coupling size is kept constant, the tensile stress applied onto the joining portion of the ball pin is decreased to succeed in enhancing the fatigue limit of load amplitude by 23–28%. The present invention therefore exhibits a remarkable effect of the preventing the fatigue failure of the ball and socket type suspension insulator used in the zone suffering from heavy snow and/or heavy ice attachment and large wind pressure variation. Further, since the present invention succeeds in the improvement of the fatigue failure strength, high tension steel is used as the material of the ball pin in the case of the suspension insulator which is to be used in a general area which may be less susceptible to large variation of the load, so that the coupling size can be made smaller while complementing the reduction in the breaking strength of the shank portion of the ball pin. Therefore, the present invention largely contributes to the development of the industries in that the problems of the conventional ball socket type suspension insulators are solved.

What is claimed is:

1. A ball and socket type suspension insulator, wherein the radius of curvature at the fillet portion between a pin shank portion and a ball portion of a ball pin buried and secured into the inside of a head portion of an insulator body is designed at 30–40% of the diameter of the pin shank portion, and the angle which a contact surface between the socket portion of the cap attached to the outer surface of the head of the insulator body and the ball pin forms with respect to the horizontal plane is 38°–45°.

* * * * *

UNITED STATES PATENT AND TRADEMARK OFFICE

CERTIFICATE OF CORRECTION

PATENT NO. : 4,551,578

DATED : November 5, 1985

INVENTOR(S) : Hiroshi NOZAKI

It is certified that error appears in the above-identified patent and that said Letters Patent is hereby corrected as shown below:

On front page of Patent change Assignee from:

"NKG Insulators, Ltd." to -- NGK Insulators, Ltd.--.

Signed and Sealed this

*Eleventh* Day of *March 1986*

[SEAL]

*Attest:*

DONALD J. QUIGG

*Attesting Officer*

*Commissioner of Patents and Trademarks*